US009441835B2

(12) United States Patent
Overby et al.

(10) Patent No.: US 9,441,835 B2
(45) Date of Patent: Sep. 13, 2016

(54) SYSTEM AND METHOD FOR FUEL AND STEAM INJECTION WITHIN A COMBUSTOR

(71) Applicant: General Electric Company, Schenectady, NY (US)

(72) Inventors: Brandon Taylor Overby, Spartanburg, SC (US); David Leach, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 169 days.

(21) Appl. No.: 13/647,359

(22) Filed: Oct. 8, 2012

(65) Prior Publication Data

US 2014/0096529 A1 Apr. 10, 2014

(51) Int. Cl.

| | |
|---|---|
| ***F23R 3/02*** | (2006.01) |
| ***F23R 3/28*** | (2006.01) |
| ***F23L 7/00*** | (2006.01) |
| *F23R 3/36* | (2006.01) |

(52) U.S. Cl.

CPC . *F23R 3/02* (2013.01); *F23L 7/00* (2013.01); *F23R 3/286* (2013.01); *F23L 2900/07002* (2013.01); *F23L 2900/07009* (2013.01); *F23R 3/36* (2013.01)

(58) Field of Classification Search

CPC ..... F23R 3/286; F23R 3/20; F23R 3/34; F23R 3/50; F23R 3/14; F23R 3/283; F23R 3/28; F23R 3/36; F23R 3/386; F23R 3/02; F23R 3/04; F23R 3/16; F23R 3/54; F23R 3/30; F23R 2900/00004; F23D 17/002; F23L 7/00; F23L 7/002; F23L 7/005; F23L 7/007; F23L 2900/07008; F23L 2900/07009; F23C 7/22; F23C 3/14; F04D 2260/14; Y02T 50/678; Y02E 50/12

USPC ..... 60/39.463, 737, 746, 747, 748, 740, 60/742

See application file for complete search history.

(56) References Cited

U.S. PATENT DOCUMENTS

| | | | | |
|---|---|---|---|---|
| 5,479,782 | A | 1/1996 | Parker et al. | |
| 5,657,632 | A * | 8/1997 | Foss | 60/742 |
| 6,438,961 | B2 * | 8/2002 | Tuthill | F23C 7/004 60/737 |
| 6,786,047 | B2 | 9/2004 | Bland et al. | |
| 7,093,445 | B2 | 8/2006 | Corr et al. | |

(Continued)

FOREIGN PATENT DOCUMENTS

EP 2224171 A1 * 9/2010

OTHER PUBLICATIONS

EP Search Report and Written Opinion dated Dec. 18, 2013, issued in connection with corresponding EP Patent Application No. 13187422.4.

*Primary Examiner* — Gerald L Sung
*Assistant Examiner* — Jared W Pike
(74) *Attorney, Agent, or Firm* — Fletcher Yoder, P.C.

(57) ABSTRACT

A system includes a gas turbine combustor configured to combust a fuel and an oxidant, such as $O_2$ and $O_2$ mixtures. The system also includes an aerodynamic peg disposed in the gas turbine combustor. The aerodynamic peg includes a first passage configured to convey a first fluid into the gas turbine combustor and a second passage configured to convey a second fluid into the gas turbine combustor. The first fluid and second fluid are different from one another.

25 Claims, 5 Drawing Sheets

(56) References Cited

U.S. PATENT DOCUMENTS

| | | | | |
|---|---|---|---|---|
| 7,536,862 | B2 * | 5/2009 | Held | F23D 11/24 60/740 |
| 7,966,820 | B2 * | 6/2011 | Romoser | F02C 7/264 239/428 |
| 2001/0049932 | A1 | 12/2001 | Beebe | |
| 2003/0024234 | A1 * | 2/2003 | Holm et al. | 60/39.463 |
| 2004/0021235 | A1 | 2/2004 | Corr, II et al. | |
| 2004/0050057 | A1 | 3/2004 | Bland et al. | |
| 2007/0151250 | A1 | 7/2007 | Haynes | |
| 2008/0078182 | A1 * | 4/2008 | Evulet | 60/776 |
| 2009/0180939 | A1 * | 7/2009 | Hagen et al. | 422/194 |
| 2010/0077760 | A1 * | 4/2010 | Laster et al. | 60/742 |
| 2010/0183991 | A1 * | 7/2010 | Kostlin et al. | 431/9 |
| 2011/0225973 | A1 | 9/2011 | Romig et al. | |
| 2011/0239652 | A1 | 10/2011 | McMahan et al. | |
| 2011/0239653 | A1 | 10/2011 | Valeev et al. | |
| 2012/0085100 | A1 * | 4/2012 | Hughes | F23R 3/286 60/776 |
| 2013/0213051 | A1 * | 8/2013 | Westmoreland, III | F23R 3/286 60/775 |
| 2015/0226434 | A1 * | 8/2015 | Nakamura | F23R 3/14 60/734 |

* cited by examiner

SYSTEM AND METHOD FOR FUEL AND STEAM INJECTION WITHIN A COMBUSTOR

BACKGROUND OF THE INVENTION

The subject matter disclosed herein relates to fluid injection systems, and, more particularly, to structures that inject multiple fluids into a combustor within a gas turbine engine.

Various combustion systems include combustion chambers in which fuel and an oxidant, such as $O_2$ and $O_2$ mixtures, combust to generate hot gases. For example, a gas turbine engine may include one or more combustion chambers that are configured to receive compressed air from a compressor, inject fuel and, at times, other fluids into the compressed air, and generate hot combustion gases to drive a turbine engine. Each combustion chamber may include one or more fuel nozzles, a combustion zone within a combustion liner, a flow sleeve surrounding the combustion liner, and a gas transition duct. Compressed air from the compressor flows to the combustion zone through a gap between the combustion liner and the flow sleeve. Unfortunately, inefficiencies may be created as the compressed air passes through the gap, thereby negatively effecting performance of the gas turbine engine.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a gas turbine combustor configured to combust a fuel and an oxidant. The system also includes an aerodynamic peg disposed in the gas turbine combustor. The aerodynamic peg includes a first passage configured to convey a first fluid into the gas turbine combustor and a second passage configured to convey a second fluid into the gas turbine combustor. The first fluid and the second fluid are different from one another.

In a second embodiment, a system includes an aerodynamic peg containing a first passage configured to convey a first fluid into a gas turbine combustor via a first orifice and a second passage configured to convey a second fluid into the gas turbine combustor via a second orifice. The first fluid and second fluid are different from one another.

In a third embodiment, a method includes injecting a first fluid into a gas turbine combustor using a first passage disposed in an aerodynamic peg and injecting a second fluid into the gas turbine combustor using a second passage disposed in the aerodynamic peg. The first fluid and second fluid are different from one another.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, the disclosed embodiments provide systems and methods for introducing a plurality of fluids into a combustion system by utilizing a single structure. In one embodiment, the structure may be used to inject two or more fluids into an airflow in a fuel nozzle, between a combustion liner and a flow sleeve, and/or between a combustor casing or combustor cap of a gas turbine combustor. Utilizing a single structure to inject multiple fluids into the airflow may reduce the total number of structures used within the space between the combustion liner and the flow sleeve. Reducing the number of structures projecting into the airflow may reduce discontinuities in the flow, such as stagnation points, vortices, and other forms of turbulence. In certain embodiments the structure may be an aerodynamically shaped peg (e.g., an airfoil), which may aid in maintaining a uniform airflow by reducing a wake in a wake region downstream from the aerodynamic peg. The aerodynamic shape of the peg may be that of an airfoil, which separates airflow into two flows using a leading edge and then enables the two flows to rejoin in a laminar fashion at a trailing edge of the aerodynamic peg. When placed in the gap between the combustion liner and the flow sleeve, the aerodynamic peg may be coupled to the flow sleeve and extend at least partially into the gap. Further, the aerodynamic peg may extend the entire length of the gap, thereby providing structural support between the flow sleeve and combustion liner.

Figure 3:
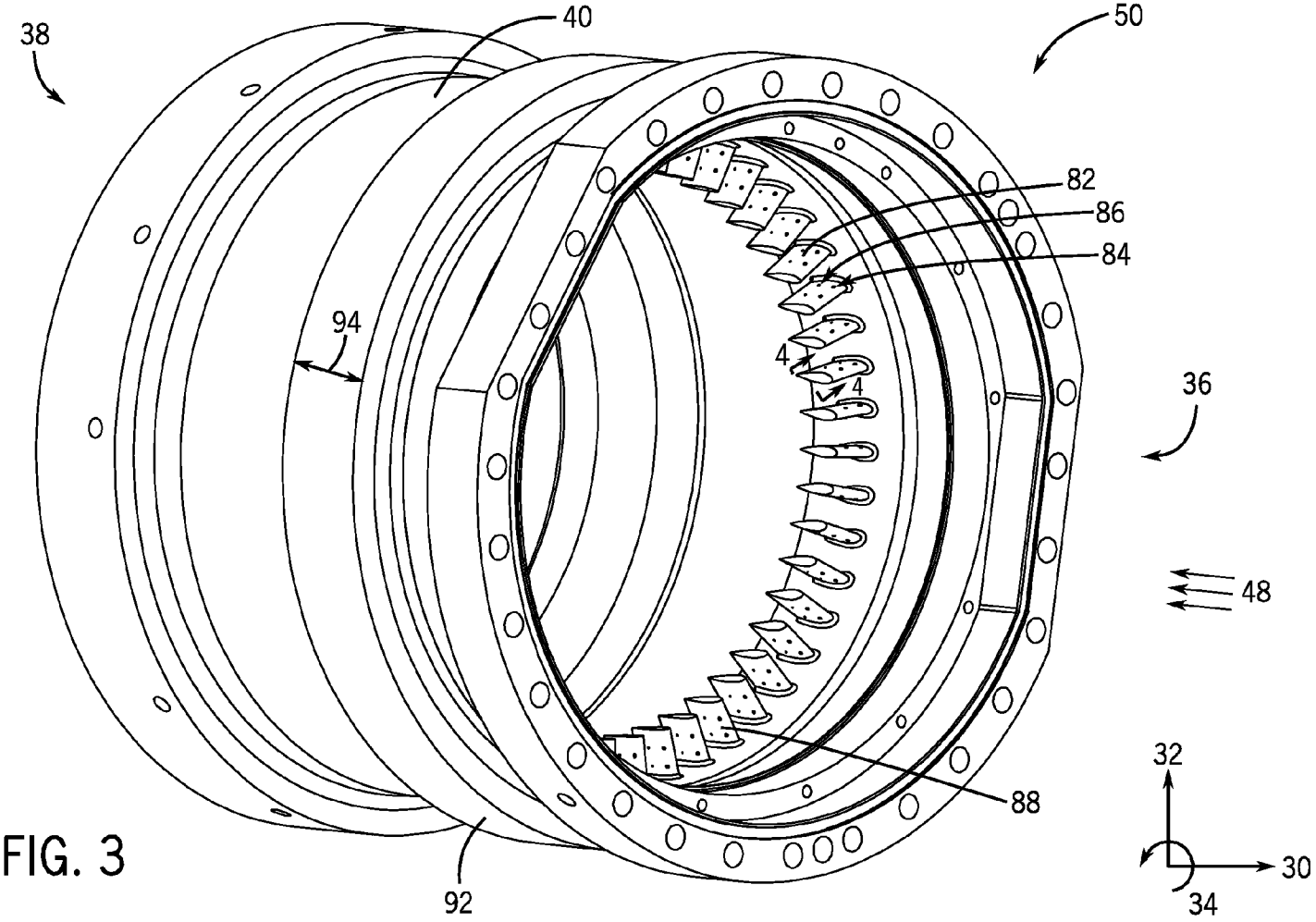
FIG. 3 is a perspective view of an embodiment of a combustor casing, illustrating an arrangement of a plurality of aerodynamic pegs within the combustor.

At casing peg location 50, at least one aerodynamic peg 82 may be affixed to the inner surface of the combustor casing 40. Similarly, at least one aerodynamic peg 82 may be coupled to the flow sleeve 41 further toward the aft end 36 of the combustor 16, (e.g., aerodynamic peg location 51), such that the at least one aerodynamic peg 82 is disposed about the combustion region. FIG. 3 illustrates an embodiment with a plurality of aerodynamic pegs 82 that may have an airfoil shape and be equidistantly spaced circumferentially from one another at a single axial location. Each aerodynamic peg 82 may include a set of first fluid orifices 84 and a set of second fluid orifices 86. The orifices 84 and 86 may inject a first fluid and a second fluid into the compressed air stream 48. For example, the first fluid orifices 84 (located towards the aft end 36) may inject steam or other non-oxidant/non-fuel fluids, and the second fluid orifices 86 (located towards the fore end 38) may be used to inject fuel. In the depicted embodiment, two first fluid orifices 84 and two second fluid orifices 86 are shown on each lateral surface of the aerodynamic pegs 82. In further embodiments, any number of orifices may be used. For example, the aerodynamic pegs 82 may include 3, 4, 5, 6, or more first fluid orifices 84 and 3, 4, 5, 6, or more second fluid orifices 86. Additionally, when implemented, any number of fluids may be accommodated by the aerodynamic peg 82. For example, the aerodynamic pegs 82 may be used to inject 3, 4, or more fluids.

This arrangement may help to prevent the possibility of flame holding and flashback that could occur if fuel incidentally travels upstream within the combustor or if the fuel is not thoroughly mixed with the compressed air, resulting in fuel-rich pockets. The use of the aerodynamic shape (e.g., airfoil) to maintain uniform airflow may also aid in the prevention of flame holding and flashback by hindering the formation of stagnant zones that may enable for the growth of fuel-rich pockets. Preventing flame holding and flashback improves performance, reliability, and helps avoid potentially damaging events. Combining multiple fluid injection sites into a singular aerodynamic structure may result in performance advantages, such as, but not limited to, improved gas turbine engine reliability, decreased pressure drop, and reduced potential of flame holding and/or flashback. Additionally, use of the singular aerodynamic structure for injecting multiple fluids may provide economic advantages, such as, but not limited to, conservation of construction materials, ease of manufacture, and ease of installation.

Figure 1:
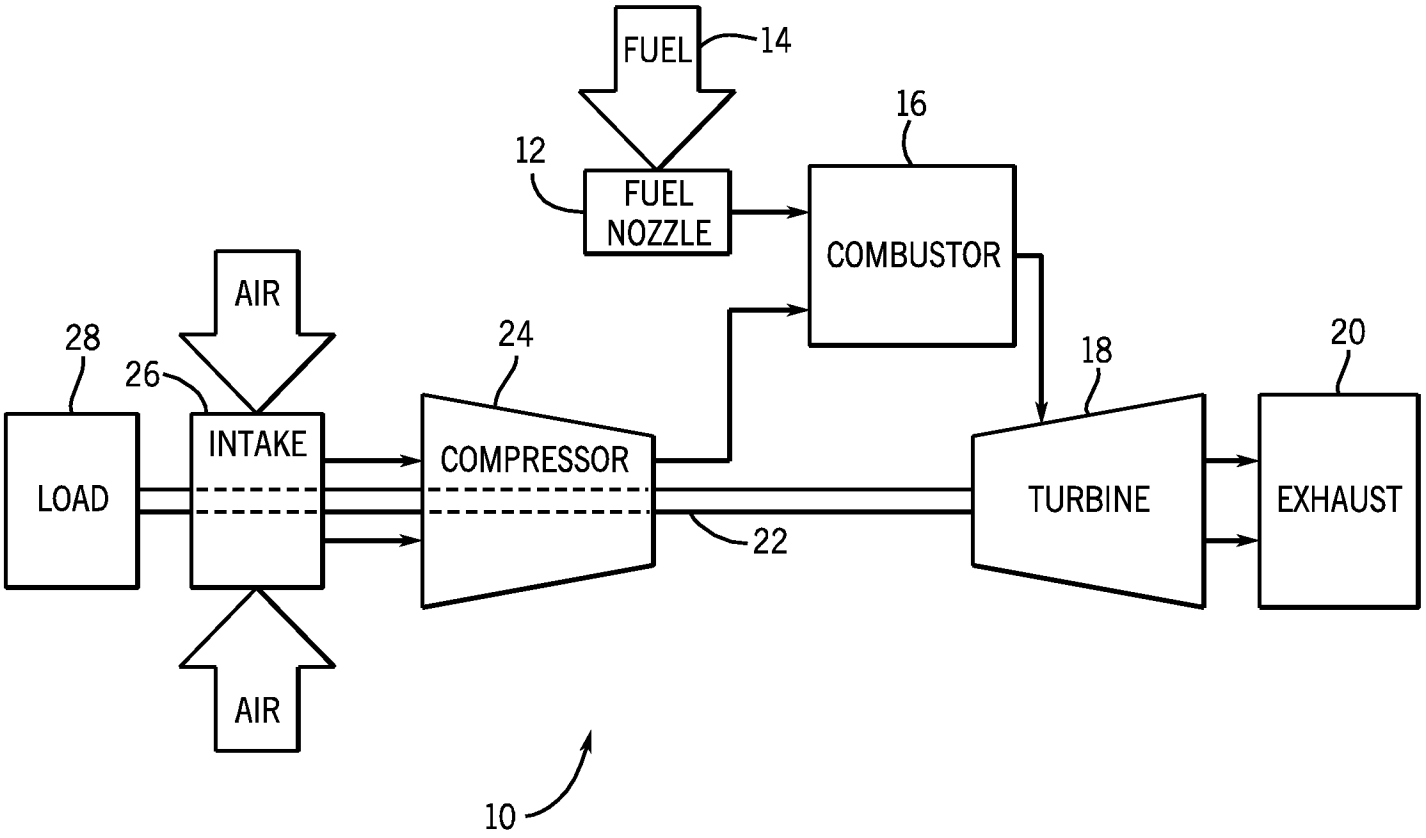
FIG. 1 is a block diagram of an embodiment of a turbine system having a combustor.

FIG. 1 is a block diagram of an embodiment of a turbine system 10. The turbine system 10 may use liquid or gas fuel, such as natural gas and/or a synthetic gas, to drive the turbine system 10. As depicted, one or more fuel nozzles 12 may intake a fuel supply 14, partially mix the fuel with air, and distribute the fuel and air mixture into the combustor 16 where further mixing occurs between the fuel and air. As described in detail in the disclosed embodiments, the combustor 16 may contain at least one aerodynamic peg to inject fuel and, at times, a non-oxidant/non-fuel fluid into the air to enhance air-fuel premixing in the combustor 16. The air-fuel mixture combusts in a chamber within the combustor 16, thereby creating hot pressurized exhaust gases. The combustor 16 directs the exhaust gases through a turbine 18 toward an exhaust outlet 20. As the exhaust gases pass through the turbine 18, the gases force turbine blades to rotate a shaft 22 along an axis of the turbine system 10. As illustrated, the shaft 22 is connected to various components of the turbine system 10, including a compressor 24. The compressor 24 also includes blades coupled to the shaft 22. As the shaft 22 rotates, the blades within the compressor 24 also rotate, thereby compressing air from an air intake 26 through the compressor 24 and into the fuel nozzles 12 and/or combustor 16. The shaft 22 may also be connected to a load 28, which may be a vehicle or a stationary load, such as an electrical generator in a power plant or a propeller on an aircraft, for example. The load 28 may include any suitable device capable of being powered by the rotational output of turbine system 10.

Figure 2:
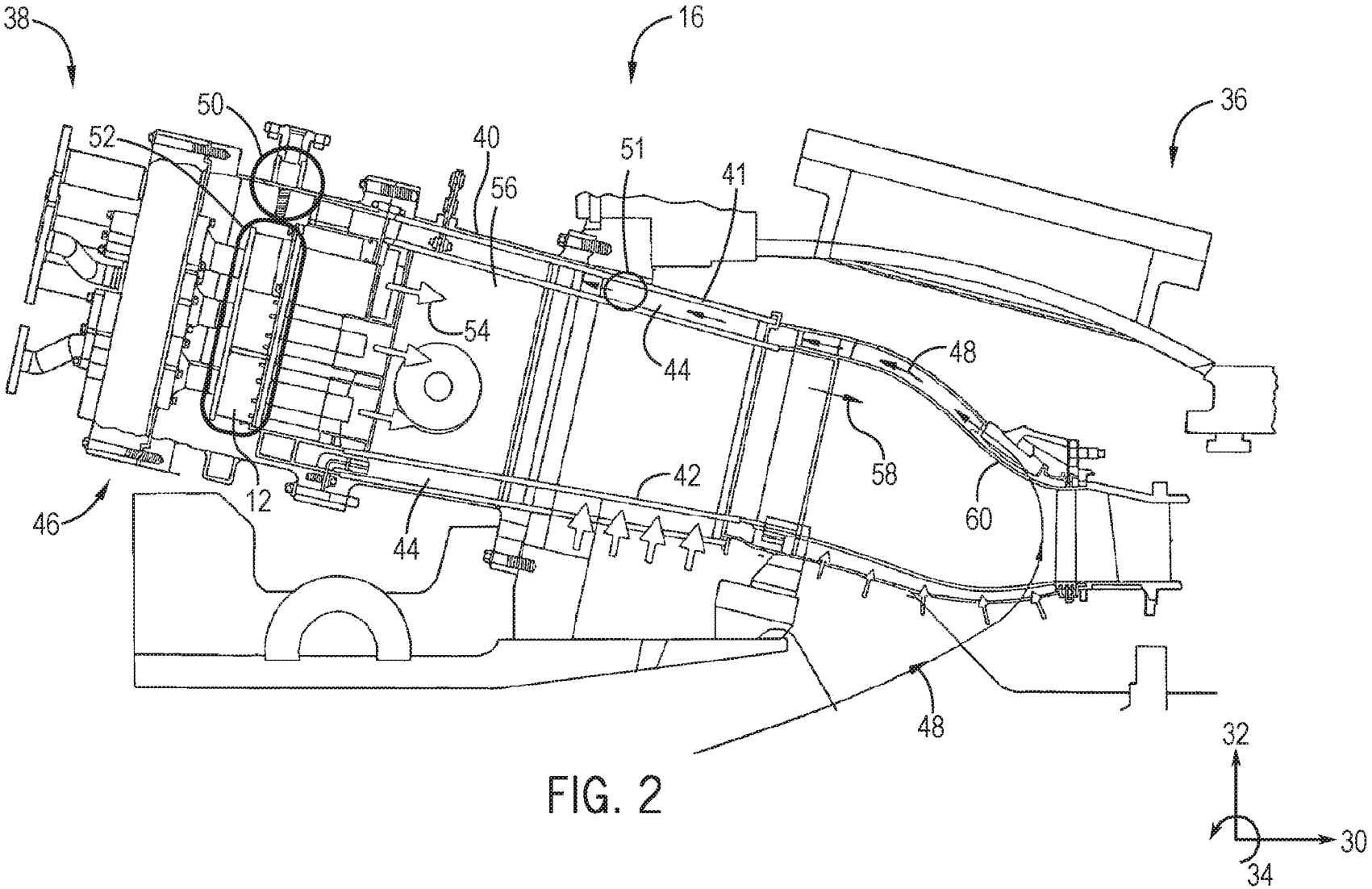
FIG. 2 is a cross-sectional side view of an embodiment of a combustor, showing locations of aerodynamic pegs.

FIG. 2 is a cross-sectional side view of an embodiment of a combustor 16. As shown in FIG. 2, an axial axis 30 runs horizontally and is considered to be generally parallel to the shaft 22. A radial axis 32 runs vertically and is generally perpendicular to the shaft 22. Lastly, a circumferential direction 34 is considered to encircle the axial axis 30. The combustor 16 is comprised of an aft end 36 and a fore end 38. The fore end 38 is located near the front (or upstream) of the turbine system 10, and the aft end 36 is located near the back (or downstream) of the turbine system 10. The radial outermost layer of the combustor 16 is the combustor casing 40, which may enclose the components of the combustor 16. Portions of the casing 40 may be directly in contact with a flow sleeve 41, which aids in cooling the components of the combustor 16. Continuing inward in the radial direction 32, the next component is a combustion liner 42, which may contain the combustion reaction. An empty space is disposed between the flow sleeve 41 and the combustion liner 42, and may be referred to as an annulus 44. The annulus 44 may direct airflow to a head end 46 of the combustor 16. The airflow through the annulus 44 includes compressed air 48, which may be generated by the compressor 24, and may be used for cooling along the combustion liner 42. The air may then mix with fuel to undergo combustion. As the compressed air 48 travels toward the fore end 38 through the annulus 44, the compressed air 48 encounters a casing peg location 50.

Located at casing peg location 50 may be at least one aerodynamic peg 82 used to inject multiple fluids into the compressed air 48. Fluids injected by aerodynamic pegs 82 may include fuel, steam, nitrogen, or other non-oxidant/non-fuel fluids (e.g., liquids or gases) used before or during the combustion reaction. The air-fuel mixture may then turn or redirect at the head end 46 (now moving toward the aft end 36) and travel toward the fuel nozzles 12 and a fuel nozzle peg location 52. Each fuel nozzle 12 is configured to partially premix air and fuel within intermediate or interior walls of the fuel nozzles 12. Aerodynamic pegs 82 may be placed at the fuel nozzle peg location 52 within the walls of the fuel nozzles 12. The aerodynamic pegs 82 may aid in premixing air-fuel mixture 54, which exits the fuel nozzles 12. The air-fuel mixture 54 travels to a combustion zone 56 where a combustion reaction takes place. The combustion reaction results in hot pressurized combustion products 58. The combustion products 58 then travel through a transition piece 60 to the turbine 18 (shown in FIG. 1).

At casing peg location 50, at least one aerodynamic peg 82 may be affixed to the inner surface of the combustor casing 40. Similarly, at least one aerodynamic peg 82 may be coupled to the flow sleeve 41 further toward the aft end 36 of the combustor 16. FIG. 3 illustrates an embodiment with a plurality of aerodynamic pegs 82 that may have an airfoil shape and be equidistantly spaced circumferentially from one another at a single axial location. Each aerodynamic peg 82 may include a set of first fluid orifices 84 and a set of second fluid orifices 86. The orifices 84 and 86 may inject a first fluid and a second fluid into the compressed air stream 48. For example, the first fluid orifices 84 (located towards the aft end 36) may inject steam or other non-oxidant/non-fuel fluids, and the second fluid orifices 86 (located towards the fore end 38) may be used to inject fuel.

In the depicted embodiment, two first fluid orifices 84 and two second fluid orifices 86 are shown on each lateral surface of the aerodynamic pegs 82. In further embodiments, any number of orifices may be used. For example, the aerodynamic pegs 82 may include 3, 4, 5, 6, or more first fluid orifices 84 and 3, 4, 5, 6, or more second fluid orifices 86. Additionally, when implemented, any number of fluids may be accommodated by the aerodynamic peg 82. For example, the aerodynamic pegs 82 may be used to inject 3, 4, or more fluids.

Each aerodynamic peg 82 shown in FIG. 3 includes a leading edge 88 and a trailing edge 90. The leading edge 88 may be located at the aft end 36 of the aerodynamic peg 82 and may separate the airflow into two flows without creating turbulence, while the trailing edge 90 may be located at the fore end 38 of the aerodynamic peg 82 and may rejoin the two flows without creating vortices. However, in other embodiments, the leading edge 88 may be located at the fore end 38 when the direction of the compressed air 48 is different, e.g., at the fuel nozzle peg location 52. As shown in FIG. 3, a manifold 92 may be affixed to the outer surface of the combustor casing 40. The manifold 92 may surround a width 94 of the casing 40 at an axial location along the circumference of the casing 40. The axial location of the manifold 92 may coincide with the axial location of the aerodynamic pegs 82. The manifold 92 may house distinct fluid paths to the first set of fluid orifices 84 and the second set of fluid orifices 86. The aerodynamic pegs 82 and the manifold 92 may be constructed as part of the combustor casing 40 or created separately and attached to the casing 40 by means of welding, brazing, use of an adhesive, or another method of attachment. The aerodynamic pegs 82, themselves, may be casted, fabricated, or otherwise constructed as determined at the time of construction.

Figure 4:
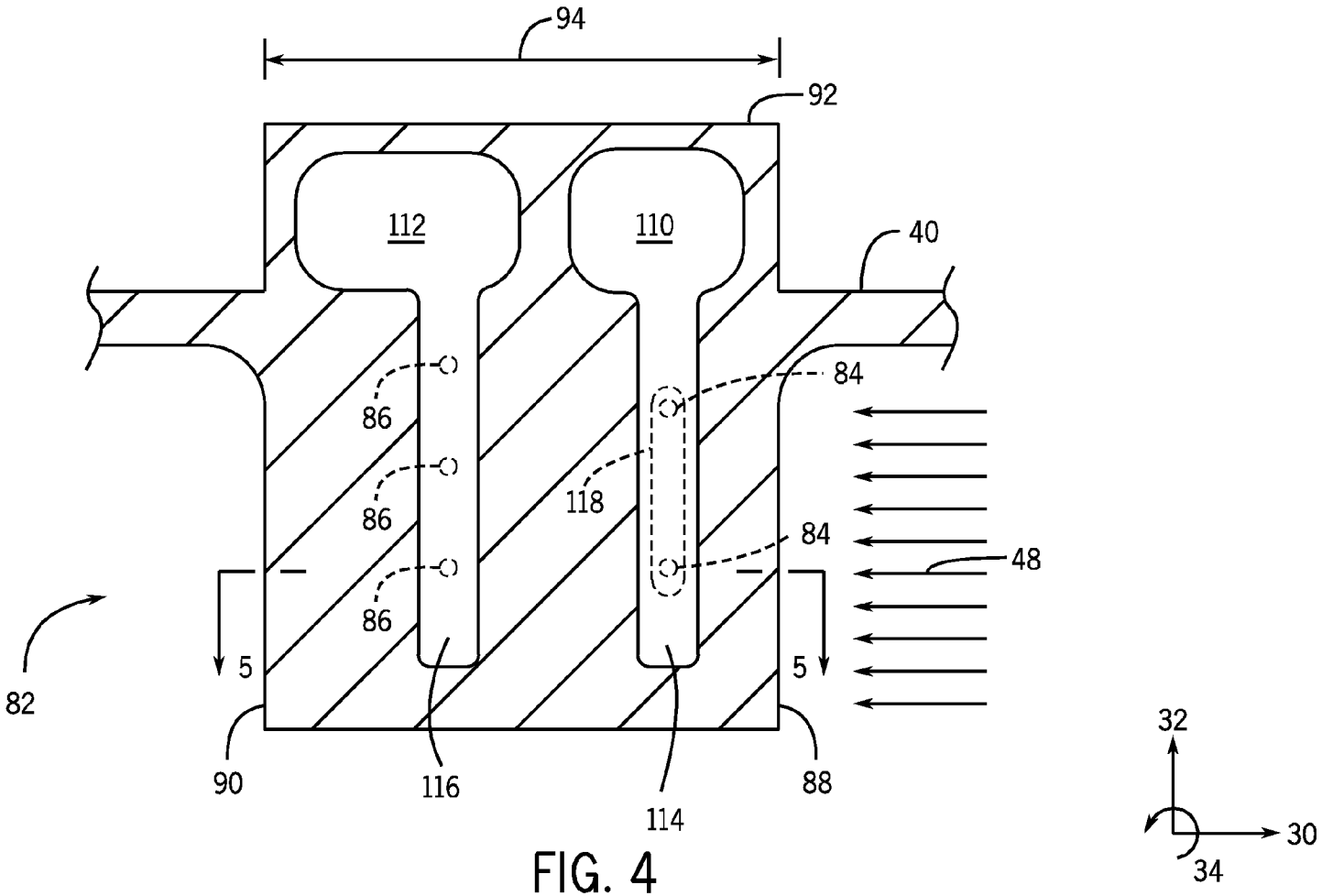
FIG. 4 is a partial cross-sectional view of an embodiment of an aerodynamic peg, as designated by line 4-4 in FIG. 3, showing an arrangement of manifolds and passages within an aerodynamic peg.

FIG. 4 illustrates a cross-sectional view of the aerodynamic peg 82, taken along the line labeled 4-4 in FIG. 3. The cross-sectional view extends through the aerodynamic peg 82, the combustor casing 40, and the manifold 92. Housed within the manifold 92, may be a first fluid manifold 110 and a second fluid manifold 112. The first fluid manifold 110 may be connected to the first fluid orifices 84 via a first fluid passage 114. The second fluid manifold 112 may be connected to the second fluid orifices 86 via a second fluid passage 116. In one embodiment, the first fluid manifold 110, first fluid passage 114, and first fluid orifices 84 may inject steam, nitrogen, or other non-oxidant/non-fuel fluids into the airflow 48, and the second fluid manifold 112, second fluid passage 116, and second fluid orifices 86 may convey fuel into the airflow 48. The first and second fluid orifices 84 and 86 are shown in FIG. 4 with circular openings, but in another embodiment may be an oval, square, rectangle, or any other shape. FIG. 4 also depicts an optional slot geometry 118 in place of the circular first fluid orifices 84. As previously stated, the aerodynamic pegs 82 may be configured to inject any number of fluids and are not limited to supplying two fluids.

Figure 5:
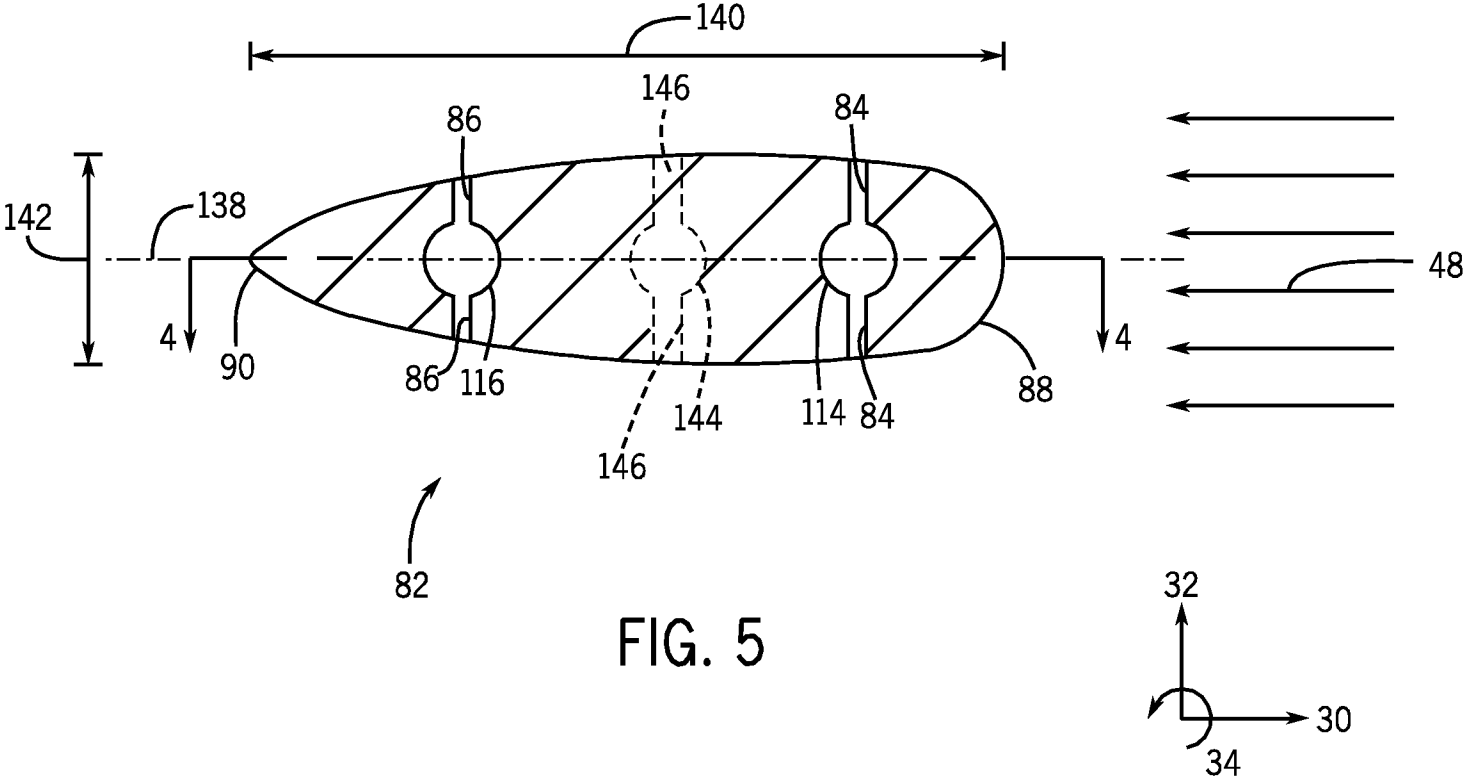
FIG. 5 is a partial cross-sectional end view of an embodiment of an aerodynamic peg, as designated by line 5-5 in FIG. 4, illustrating an arrangement of passages and orifices within an aerodynamic peg.

FIG. 5 illustrates a cross-sectional end view of the aerodynamic peg 82, orifices 84, 86, and passages 114, 116 taken along the line labeled 5-5 in FIG. 4. FIG. 5 depicts compressor airflow 48 approaching the leading edge 88 of the aerodynamic peg 82. The compressor airflow 48 and the axial axis 30 of the combustor 16 may be generally parallel to a longitudinal axis 138 of the aerodynamic peg 82, causing the compressor airflow 48 to directly impact the leading edge 88. The aligned, direct impact of the airflow 48 may reduce flow disturbances caused by the aerodynamic peg 82. A length 140 of the aerodynamic peg 82 is measured along the longitudinal axis 138. A width 142 of the aerodynamic peg 82 is measured perpendicular to the longitudinal axis 138 at the thickest point. The length 140 to width 142 ratio depicted in FIG. 5 is approximately 3.5:1; however, any length 140 to width 142 ratio may be used in the disclosed embodiments. For example, the length 140 to width 142 ratio may be between approximately 1.1:1 to 10:1, 1.5:1 to 5:1, or 2:1 to 4:1.

In the embodiment presented in FIG. 5, the two fluid passages 114 and 116 are located at the longitudinal axis 138 and have circular cross-sections. However, the fluid passages 114 and 116 may be located eccentrically from the longitudinal axis 138, may comprise any cross-sectional geometry, and may be of various sizes. Additionally, the aerodynamic peg 82 may include any number of passages greater than two, such as 3, 4, 5, or more passages. For example, an optional fluid passage 144 is shown via dashed lines in FIG. 5 with a corresponding orifice 146 also shown. The optional fluid passage 144 may be used to convey additional fluids, such as air, nitrogen, or other fluids. The embodiment in FIG. 5 depicts the fluid orifices 84, 86, and 146 extending perpendicularly from the longitudinal axis 138. However, the fluid orifices 84, 86, and 146 may extend from the fluid passages 114, 116, and 144 at any angle. For example, the orifices 84, 86, and 146 may extend toward the leading edge 88 or toward the trailing edge 90. Furthermore, although shown extending toward both lateral surfaces of the aerodynamic peg 82, the orifices 84, 86, and 146 may extend toward only one lateral surface of the aerodynamic peg 82 in other embodiments.

The above disclosed embodiments illustrate the use of a single structure for introducing a plurality of fluids into a combustion system via a single aerodynamic peg 82 placed within the combustor 16 of a turbine engine. The aerodynamic pegs 82 may be used to inject two or more fluids into the airflow 48 in the annulus 44 of a combustor 16 and/or into the airflow within the fuel nozzles 12. When located in the annulus 44, the aerodynamic pegs 82 may extend partially into the annulus 44 or extend completely across the annulus 44, enabling structural support between the flow sleeve 41 and combustion liner 42. The aerodynamic pegs 82 may include at least two passages 114 and 116 to inject the fluids into the airflow, and each passage 114 and 116 may connect to at least one orifice 84 and 86 on a lateral surface of the aerodynamic peg 82. The aerodynamic shape may include a variety of airfoil cross-sections to maintain uniform airflow and aid in the prevention of flame holding and/or flashback by hindering the formation of stagnant zones, resulting in improved reliability of the combustor 16. There may be multiple performance advantages, such as, improved gas turbine engine reliability, decreased pressure drop, and reduced potential of flame holding and/or flashback. Additionally, use of the singular aerodynamic structure may result in economic advantages, such as, conservation of materials and ease of manufacture and assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a gas turbine combustor comprising a combustion region downstream from a head end region, wherein the head end region comprises one or more fuel nozzles, wherein the combustion region is configured to combust one or more fuels and an oxidant and flow combustion gases in a downstream direction away from the head end region, wherein the gas turbine combustor comprises a first wall disposed about at least one of the head end region or the combustion region, and a second wall disposed about the first wall to define a flow path configured to flow fluid in an upstream direction opposite the downstream direction into the head end region; and an aerodynamic peg coupled to at least one of the first or second wall within the flow path in the gas turbine combustor, wherein the aerodynamic peg is oriented in a radial direction relative to an axis of the gas turbine combustor, wherein the aerodynamic peg comprises:

one or more non-oxidant, non-fuel outlets coupled to a non-oxidant, non-fuel passage, wherein the one or more non-oxidant, non-fuel outlets are configured to convey only a non-oxidant, non-fuel fluid into the flow path of the gas turbine combustor;

and one or more fuel outlets coupled to a fuel passage, wherein the one or more fuel outlets are configured to convey only a fuel into the flow path of the gas turbine combustor, wherein the one or more non-oxidant, non-fuel outlets are disposed upstream from the one or more fuel outlets.

2. The system of claim 1, wherein the aerodynamic peg comprises an airfoil shaped cross-section.

3. The system of claim 2, wherein the one or more non-oxidant, non-fuel outlets and the one or more fuel outlets are disposed between a leading edge and a trailing edge of the airfoil shaped cross-section.

4. The system of claim 3, wherein the aerodynamic peg comprises:

a first side extending between the leading edge and the trailing edge, wherein the first side comprises one or more fuel outlets and one or more non-oxidant, non-fuel outlets; and a second side between the leading edge and the trailing edge, opposite the first side, wherein the second side comprises one or more fuel outlets and one or more non-oxidant, non-fuel outlets.

5. The system of claim 1, comprising a manifold disposed surrounding the gas turbine combustor and coupled to the non-oxidant, non-fuel passage and the fuel passage, wherein the manifold is configured to convey the non-oxidant, non-fuel fluid and the fuel to the non-oxidant, non-fuel passage and the fuel passage.

6. The system of claim 5, wherein the manifold comprises a non-oxidant, non-fuel manifold configured to convey the non-oxidant, non-fuel fluid and a fuel manifold configured to convey the fuel.

7. The system of claim 1, wherein the first wall is disposed about the combustion region, and the aerodynamic peg is disposed within the flow path about the combustion region.

8. The system of claim 1, wherein the aerodynamic peg is disposed about the head end region.

9. The system of claim 7, wherein the gas turbine combustor comprises:

a plurality of aerodynamic pegs, including the aerodynamic peg, equidistantly spaced circumferentially from one another, wherein each of the plurality of aerodynamic pegs is coupled to at least one of the first or second wall within the flow path.

10. The system of claim 7, wherein the aerodynamic peg extends only partially across the flow path between the first and second walls.

11. The system of claim 1, wherein the non-oxidant, non-fuel fluid comprises steam.

12. The system of claim 1, wherein the non-oxidant, non-fuel fluid comprises nitrogen.

13. The system of claim 1, comprising a gas turbine engine having the gas turbine combustor.

14. The system of claim 1, comprising a third passage disposed in the aerodynamic peg and configured to convey a third fluid into the gas turbine combustor, wherein the non-oxidant, non-fuel fluid, the fuel, and the third fluid are different from one another.

15. The system of claim 1, comprising a fuel supply and a non-oxidant, non-fuel fluid supply, wherein the one or more fuel outlets are coupled to the fuel supply and are not coupled to the non-oxidant, non-fuel fluid supply, wherein the one or more non-oxidant, non-fuel outlets are coupled to the non-oxidant, non-fuel fluid supply and are not coupled to the fuel supply.

16. A system, comprising:

a gas turbine engine, comprising:

a turbine: and a gas turbine combustor, wherein the gas turbine combustor comprises:

a first wall disposed about a combustion region wherein the combustion region is configured to combust one or more fuels and an oxidant downstream from a head end region and the combustion region is configured to flow combustion gases in a downstream direction away from the head end region;

a second wall disposed about the first wall to define a flow path configured to flow fluid in an upstream direction opposite the downstream direction toward the head end region; and an aerodynamic peg coupled to at least one of the first or second wall within the flow path, wherein the aerodynamic peg is oriented in a radial direction relative to an axis of the gas turbine combustor, wherein the aerodynamic peg comprises:

one or more non-oxidant, non-fuel outlets coupled to a non-oxidant, non-fuel passage, wherein the one or more non-oxidant, non-fuel outlets are configured to convey only a non-oxidant, non-fuel fluid into the flow path of the gas turbine combustor; and one or more fuel outlets coupled to a fuel passage, wherein the one or more fuel outlets are configured to convey only a fuel into the flow path of the gas turbine combustor, wherein the one or more non-oxidant, non-fuel outlets are disposed upstream of the one or more fuel outlets.

17. The system of claim 16, wherein the non-oxidant, non-fuel passage is coupled to a non-oxidant, non-fuel manifold to supply the non-oxidant, non-fuel fluid, and the fuel passage is coupled to a fuel manifold to supply the fuel.

18. The system of claim 16, wherein the aerodynamic peg is coupled to the second wall and extends toward the first wall of the gas turbine combustor, the first wall comprises a combustion liner, and the second wall comprises a flow sleeve configured to receive a compressed flow from a compressor.

19. The system of claim 16, wherein the aerodynamic peg extends only partially across the flow path between the first and second walls.

20. The system of claim 16, wherein the aerodynamic peg comprises an airfoil shaped cross-section extending from a leading edge in a downstream direction to a trailing edge, wherein the one or more non-oxidant, non fuel outlets and the one or more fuel outlets are disposed between the leading edge and the trailing edge.

21. The system of claim 20, wherein the aerodynamic peg comprises:

a first side extending between the leading edge and the trailing edge, wherein the first side comprises one or more fuel outlets and one or more non-oxidant, non-fuel outlets; and a second side between the leading edge and the trailing edge, opposite the first side, wherein the second side comprises one or more fuel outlets and one or more non-oxidant, non-fuel outlets.

22. A method, comprising:

injecting only a non-oxidant, non-fuel fluid through one or more non-oxidant, non-fuel outlets disposed in an aerodynamic peg into a gas turbine combustor, the gas turbine combustor comprising a combustion region downstream from a head end region, wherein the head end region comprises one or more fuel nozzles, wherein the combustion region is configured to combust one or more fuels and an oxidant and flow combustion gases in a downstream direction away from the head end region, wherein the gas turbine combustor comprises a first wall disposed about at least one of the head end region or the combustion region, and a second wall disposed about the first wall to define a flow path configured to flow fluid in an upstream direction opposite the downstream direction into the head end region, wherein the aerodynamic peg is coupled to at least one of the first or second wall within the flow path in the gas turbine combustor, wherein the aerodynamic peg is oriented in a radial direction relative to an axis of the gas turbine combustor; and injecting only a fuel through one or more fuel outlets disposed in the aerodynamic peg into the gas turbine combustor, wherein the one or more non-oxidant, non-fuel outlets are disposed upstream from the one or more fuel outlets.

23. The method of claim 22, comprising:

reducing a wake in a wake region downstream from the aerodynamic peg along a fluid path of the gas turbine combustor, wherein reducing the wake comprises:

dividing the fluid into a first flow and a second flow; and aerodynamically combining the first and second flows, and the injected non-oxidant, non-fuel fluid and fuel into the wake region.

24. The method of claim 22, wherein the first wall is disposed about the combustion region, and the aerodynamic peg is disposed within the flow path about the combustion region.

25. The method of claim 22, comprising simultaneously injecting:

only a non-oxidant, non-fuel fluid through one or more non-oxidant, non-fuel outlets; and only a fuel through one or more fuel outlets.

* * * * *